United States Patent [19]

Halley

[11] Patent Number: 4,848,607

[45] Date of Patent: Jul. 18, 1989

[54] CLASSIFIER

[75] Inventor: David G. Halley, Renton, Wash.

[73] Assignee: Weyerhaeuser Company, Tacoma, Wash.

[21] Appl. No.: 83,597

[22] Filed: Aug. 7, 1987

[51] Int. Cl.[4] ..... B07B 1/28; B07B 1/46

[52] U.S. Cl. ..... 209/319; 209/341; 209/365.2; 209/405; 209/412; 248/900

[58] Field of Search ..... 209/311, 315, 319, 325, 209/326, 329, 332, 341, 342, 363, 364, 365.1, 365.2, 405, 409, 412–415; 248/559, 900

[56] References Cited

U.S. PATENT DOCUMENTS

| | | | |
|---|---|---|---|
| 275,320 | 4/1883 | Allen | 209/342 X |
| 318,983 | 6/1885 | Hecker | 209/332 |
| 1,312,324 | 8/1919 | Hawkins | 209/342 X |
| 2,120,032 | 6/1938 | Mess et al. | 209/332 X |
| 2,191,504 | 2/1940 | Smith | 209/365.3 X |
| 2,663,423 | 12/1953 | Wheeler | 209/325 X |
| 3,331,508 | 7/1967 | Andren | 209/319 |
| 4,107,035 | 8/1978 | Foresman | 209/315 X |

FOREIGN PATENT DOCUMENTS

| | | | |
|---|---|---|---|
| 0110580 | 10/1917 | United Kingdom | 209/409 |

*Primary Examiner*—Johnny D. Cherry
*Assistant Examiner*—Edward M. Wacyra

[57] ABSTRACT

A tray classifier in which the trays are locked together easily, and stay locked together while being shaken, but are movable with respect to each other if the trays came in contact with an object. The trays have upper and lower locking surfaces which nest with the locking surfaces of the stack locking member of an adjacent upper or lower tray.

12 Claims, 3 Drawing Sheets

25
25
25
25
22
23
20
18
18
20
20
18
20
23
22
24
17
19
14
15
19
12
10
17
11
13
16
11
11
11

Fig. 3
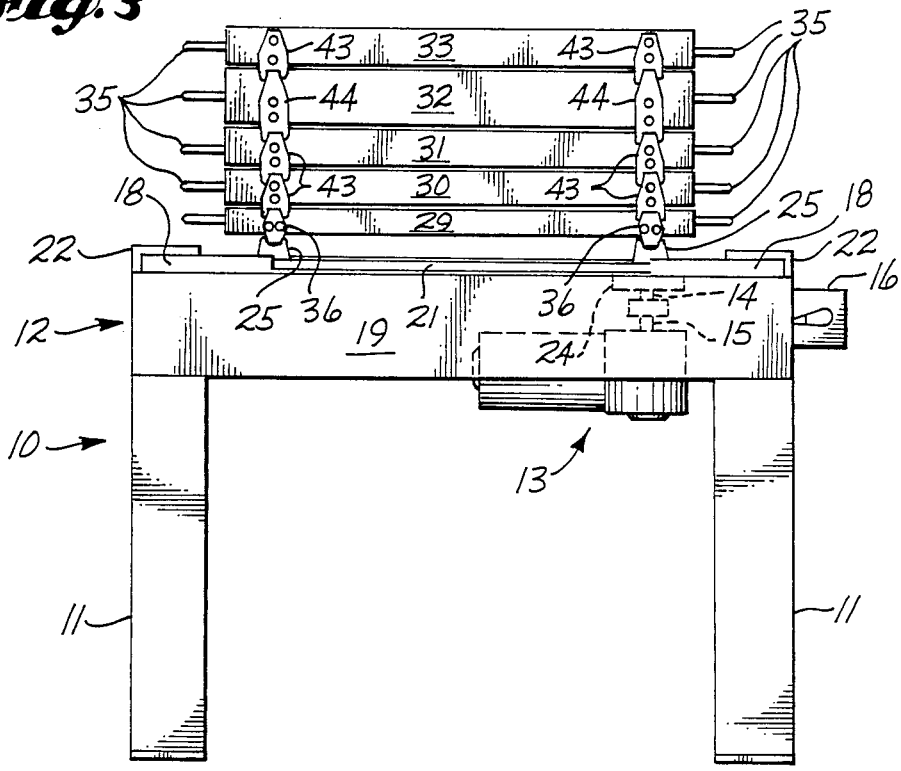
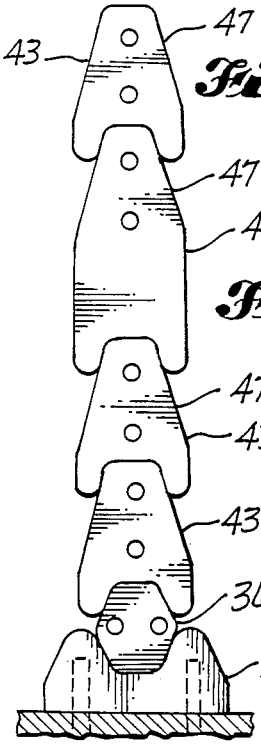
Fig. 4
Fig. 7
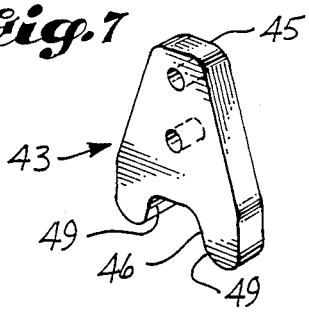
Fig. 6
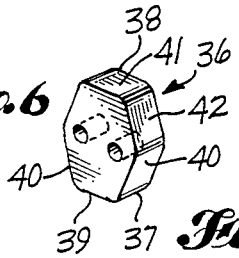
Fig. 8
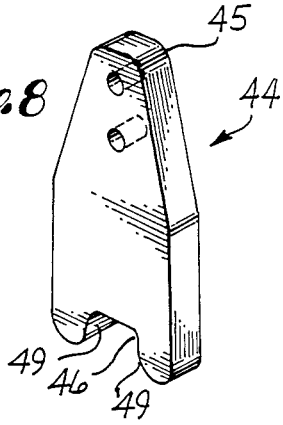
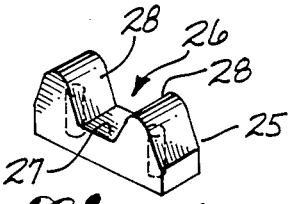
Fig. 5

CLASSIFIER

BACKGROUND OF THE INVENTION

Vibratory classifying screens are old and well known. Typical classifying screens are shown in Voith U.S. Pat. No. 288,187, granted Nov. 27, 1883; Howard U.S. Pat. No. 857,942, granted June 25, 1907; Rice U.S. Pat. No. 1,034,302, granted July 30, 1912; Wildhaber U.S. Pat. No. 1,331,303, granted Feb. 17, 1920; Seaman U.S. Pat. No. 1,141,727, granted June 1, 1915; Bell U.S. Pat. No. 1,174,657, granted Mar. 7, 1916; Bell U.S. Pat. No. 1,291,371, granted Jan. 14, 1919; Cobb U. S. Pat No. 1,491,583, granted Apr. 22, 1924; Reynolds et al U.S. Pat. No. 1,991,001, granted Feb. 12, 1935; Wettlaufer U.S. Pat. No. 2,029,848, granted Feb. 4, 1936; Hinklf U.S. Pat. No. 2,106,742, granted Feb. 1, 1938; Gilson U.S. Pat. No. 2,358,453, granted Sept. 19, 1944; Ward U.S. Pat. No. 2,384,715, granted Sept. 11, 1945; McDonell U.S. Pat. No. 2,399,280, granted Apr. 30, 1946; Missien U.S. Pat. No. 2,730,236, granted Jan. 10, 1956; Aker U.S. Pat. No. 2,748,942, granted June 5, 1956; Van Zelst U.S. Pat. No. 2,862,620, granted Dec. 2, 1958; Parks U.S. Pat. No. 3,044,624, granted July 17, 1962, U.S. Pat. No. 3,045,824, granted July 24, 1962, and U.S. Pat. No. 3,081,875, granted Mar. 19, 1963; Tonjes et al U.S. Pat. No. 3,098,037, granted July 16, 1963; Greenwell U.S. Pat. No. 3,109,808, granted Nov. 5, 1963; Loock et al U.S. Pat. No. 3,367,497, granted Feb. 6, 1968; Tonjes et al U.S. Pat. No. 3,367,498, granted Feb. 6, 1968; Tonjes U.S. Pat No. 3,481,468, granted Dec. 2, 1969; Frangos U.S. Pat. No. 3,640,386; Ljunggvist U.S. Pat. No. 3,804,246, granted Apr. 16, 1974; and Gundlach U.S. Pat. No. 4,233,151, granted Nov. 11, 1980. In these devices the trays are in a fixed position in relation to each other.

SUMMARY OF THE INVENTION

The inventor wanted a tray classifier in which the trays would be locked together easily, and stay locked together while being shaken. However, he also wanted the trays to be movable with respect to each other if the trays came in contact with an object.

He devised stack locking members on each of the trays which have upper and lower locking surfaces which nest with the locking surfaces of the stack locking member of an adjacent upper or lower tray. The locking surfaces may be either male or female. The side faces of the male and female locking surfaces are angled outwardly. The stack locking members may have a male and a female locking surface, two male locking surfaces or two female locking surfaces. The only requirement is a male locking surface be opposite a female locking surface on adjacent stack locking members so that the locking surfaces nest and the trays are held in position by gravity. The female locking surface is movable with respect to the adjacent male locking surface if the tray should come in contact with an object or person.

The preferred angle of the side faces of the locking surfaces is 25° from the vertical. The angle can be from 20° to 30°. It should not be so steep that a tray will not move when it strikes an object, or so flat that the trays will not stay together when being shaken.

BRIEF DESCRIPTION OF THE DRAWINGS

FIG. 3 is a side plan view of the classifier.

FIG. 4 is a side plan view of the tray locking assembly.

FIGS. 5–8 are isometric views of the individual tray locking members.

DETAILED DESCRIPTION OF THE INVENTION

Figure 1:
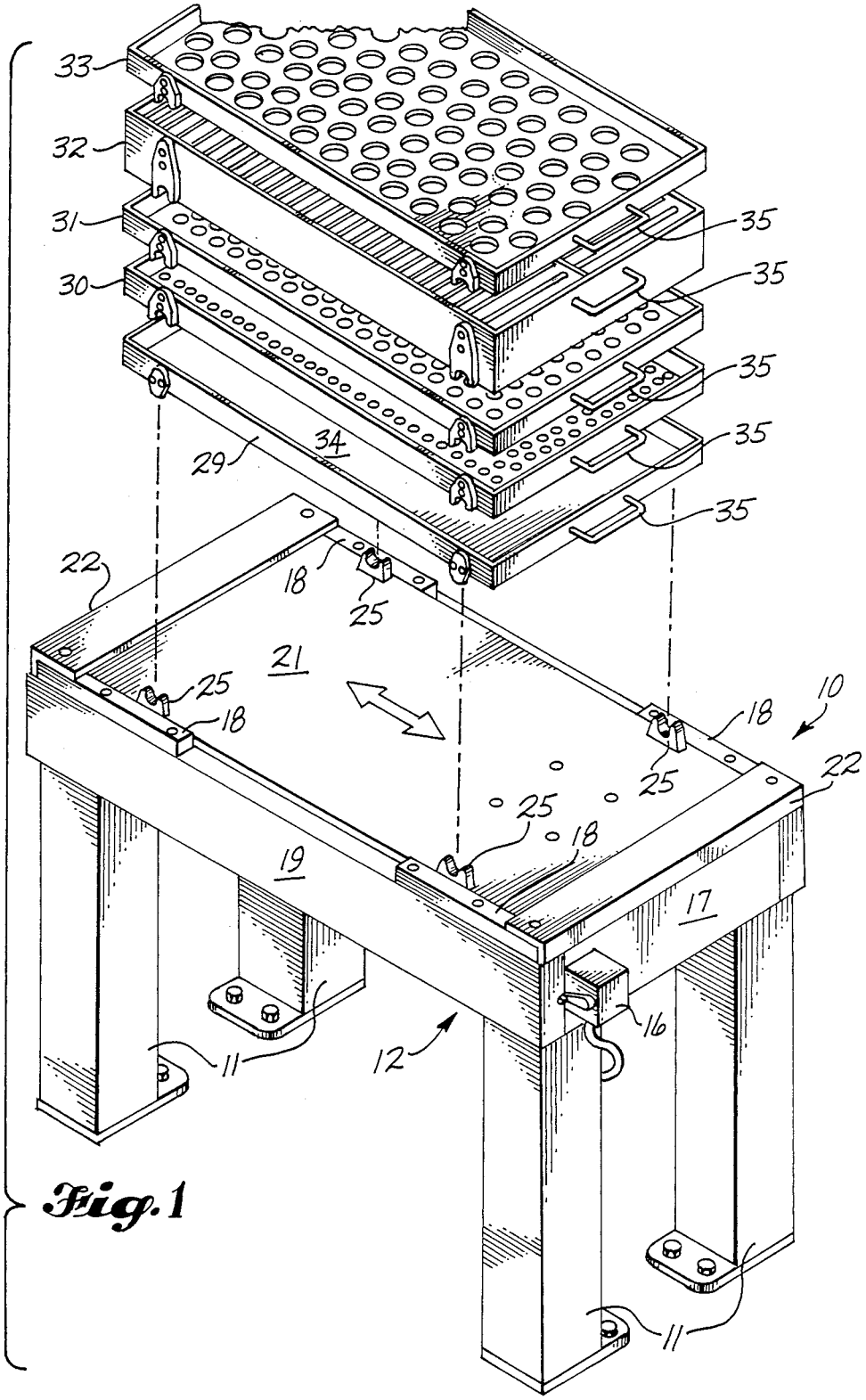
FIG. 1 is an exploded isometric view of the classifier showing details of the trays.
Figure 2:
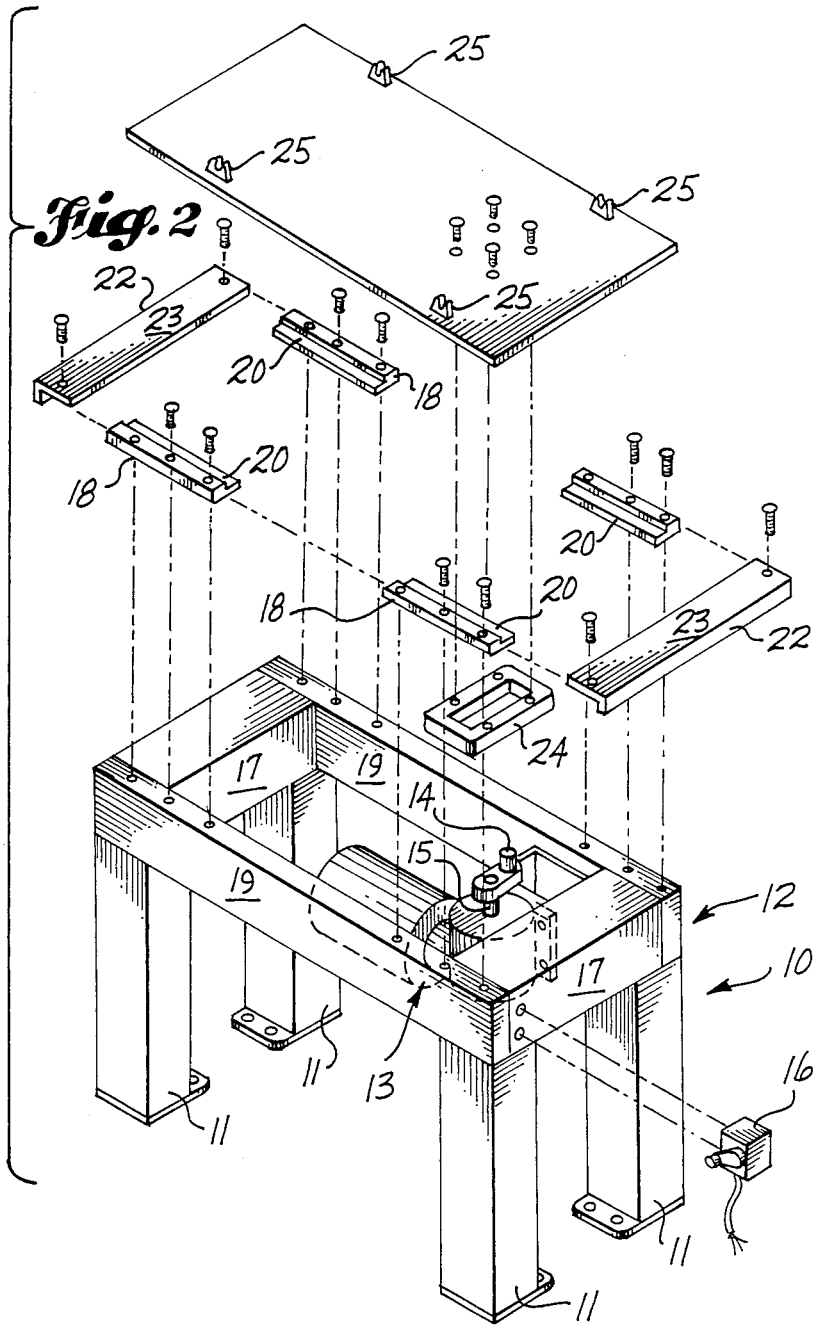
FIG. 2 is an exploded isometric view of the base of the classifier showing details of the drive.

The classifier is shown in FIGS. 1–3. The base 10 has legs 11 and an upper frame 12. A motor 13 is mounted on frame member 12. An offset cam 14 is mounted on the shaft 15 of the motor 13. The motor switch 16 is mounted on one of the end members 17 of the upper frame 12.

Two pair of side rails 18 are mounted on the side members 19 of upper frame 12. The side rails 18 are routed on their inner edges to provide a sliding surface 20 for plate 21. A pair of safety covers 22 are mounted on the end members 17. The safety covers 22 are L-shaped and the upper face 23 of each safety cover 22 fits over the upper face of plate 21. The ends of the plate 21 remain beneath the upper faces 23 of the safety covers 22 during movement of the plate.

A scotch yoke 24 is fastened to the lower face of plate 21. It acts as a cam follower for cam 14, sliding the plate 21 back and forth on the surfaces 20.

Four tray mounts 25 are fastened to the upper face of plate 21. The tray mounts are shown in greater detail in FIGS. 4 and 5. The tray mount has an upper central female locking surface 26. The central face 27 of locking surface 26 is flat and horizontal. It may be rounded. The side faces 28 of the locking surface 26 are angled upwardly and outwardly from the vertical plane. The locking surface 26 nests with the lower locking surface of the stack locking member of the lower tray 29.

A series of trays 29–33 are stacked on the sliding plate 21. The trays are used for classifying material and there is a range of different sized holes or slots in the trays, with the largest holes being in upper tray 33 and the smallest holes being in lower tray 30. The bottom tray 29 catches the material that passes through the other trays. It has a continuous plate 34 for a bottom surface. Each of the trays has a pair of handles 35 mounted on the end faces of the tray.

Each of the trays has a pair of stack locking members attached to each side face of the tray. Three styles of stack locking members are illustrated.

The stack locking member 36 on the lower tray 29 is designed to nest with the locking surface of a tray mounts 25 and with the locking surface of another stack locking member. It is illustrated in greater detail in FIGS. 4 and 6. It has upper and lower male locking surfaces 37 and 38. The shapes of these surfaces is identical. The shape of the lower locking surface 37 is the obverse of the shape of depression 26 in the mounting member 25. It has a lower horizontal face 39 and side faces 40 which angle upwardly and outwardly from the vertical plane. The upper locking surface 38 has an upper horizontal face 41 and side faces 42 which angle downwardly and outwardly from the vertical plane.

The stack locking members on the other trays are identical except for differences in height. Two heights are illustrated. The short stack locking member 43 is illustrated in FIGS. 4 and 7, and the tall stack locking member 44 is illustrated in FIGS. 4 and 8. The height of a stack locking member will depend on the height of the tray. If desired the stack locking members will have a height that will provide a space between the trays so that material may spill out if the tray becomes full.

Each of the stack locking members 43 and 44 has an upper male locking surface 45 and a lower female locking surface 46. The upper male locking surface 45 has the same shape as the upper locking surface 38 of stack locking member 36. The side faces 47 continue downwardly until they meet the vertical side walls 48 of the members. The lower female locking surface 46 has the same shape as depression 26 except that the side faces 49 extend downwardly and outwardly instead of upwardly and outwardly.

It should be remembered that the male and female locking surfaces are interchangeable. The preferred form of stack locking members has been illustrated. However, the female locking surfaces of tray mounts 25 can be male locking surfaces and the stack locking members may have two male or two female locking surfaces instead of the single male and female locking surface shown. The male and female locking surfaces on the stack locking members shown may be reversed with the male locking surface on the lower face and the female locking surface on the upper face.

The total area of the faces that form a locking surface will depend on the weight of the trays and the material in the trays, and the material forming the stack locking member. The preferred angle for the side faces of the locking surfaces is 25° from the vertical, but it may be from 20° to 30° to the vertical. The depth of the locking surface and the angles of the side faces should allow the trays to remain locked together during normal reciprocating motion of the trays but should allow a tray to move relative to the tray below it if the upper tray comes in contact with an object.

The stack locking members may be of any material. They should have surfaces which will slide relative to each other if this is necessary.

In use the trays are stacked on each other using the tray mount of the sliding plate, and the stack locking members on each tray. The material to be screened or classified is placed in the upper tray and the motor is turned on. The plate 21 is reciprocated and the material is shaken through the various trays to classify the material.

I claim:

1. Apparatus comprising means for reciprocating a tray, tray supporting members on said reciprocating means, each of said tray supporting members having a vertical plane passing through it, said vertical plane being transverse to the direction of reciprocation, each of said tray supporting members having an upper supporting surface, each of said upper supporting surfaces having a longitudinal dimension that is parallel to the direction of reciprocation and transverse to said vertical plane.

each of said upper supporting surfaces having a pair of first holding faces that are oblique in the direction of said longitudinal dimension, the faces of each pair of faces being on opposite sides of said supporting member vertical plane, a first tray, said first tray having stacking members vertically aligned with said tray supporting members, each of said first tray stacking members having a lower stacking surface which conforms to and nests with its respective upper supporting surface, each of said lower stacking surfaces having a pair of second holding faces that are contiguous with their respective first holding faces, each of said oblique holding faces being at an angle which allows said tray to remain in position on said tray support members when normally loaded and reciprocated but to disengage from said tray support members when said tray contacts an outside object.

2. The apparatus of claim 1 wherein each of said pairs of first and second holding faces extend at an upward and outward angle with respect to said vertical plane.

3. The apparatus of claim 1 wherein each of said pairs of first and second holding faces extend at a downward and outward angle with respect to said vertical plane.

4. The apparatus of claim 1 further comprising each of said stacking members having an upper supporting surface, each of said stacking member upper supporting surfaces having a longitudinal dimension that is parallel to the direction of reciprocation and transverse to said vertical plane, each of said stacking member upper supporting surfaces having a pair of third holding faces that are oblique in the direction of said longitudinal dimension, the faces of each pair of faces being on opposite sides of said stacking member vertical plane, a second tray, said second tray having second stacking members vertically aligned with said first tray stacking members, each of said second tray stacking members having a lower stacking surface which conforms to and nests with its respective first tray stacking member upper supporting surface, each of said second tray lower stacking surfaces having a pair of fourth holding faces that are contiguous with their respective third holding faces, each of said pairs of third and fourth holding faces being at an angle which allows said second tray to remain in position on said first tray when normally loaded and reciprocated but to disengage from said first tray when said second tray contacts an outside object.

5. The apparatus of claim 4 wherein each of said pairs of third and fourth holding faces extend at an upward and outward angle with respect to said vertical plane.

6. The apparatus of claim 4 wherein each of said pairs of third and fourth holding faces extend at a downward and outward angle with respect to said vertical plane.

7. A tray comprising a pair of side faces and a pair of end faces, stacking members on opposed sides of said tray, each of said stacking members having a vertical plane passing through it, said vertical plane being transverse to the direction of said opposed sides, each of said stacking members having a lower stacking surface having a longitudinal dimension that is parallel to the direction of said opposed sides and transverse to said vertical plane, each of said lower stacking surfaces having a pair of lower holding faces that are oblique in the direction of said longitudinal dimension, the faces of each pair of lower holding faces being on opposite sides of said vertical plane, each of said oblique holding faces being at an angle which allows said tray to remain in position on tray support members having oblique faces which nest with said stacking member oblique faces when normally loaded and reciprocated in the direction of said longitudinal dimension but to disengage from said tray support members when said tray contacts an outside object.

8. The apparatus of claim 7 wherein each of said pairs of lower holding faces extend at an upward and outward angle with respect to said vertical plane.

9. The apparatus of claim 7 wherein each of said pairs of lower holding faces extend at a downward and outward angle with respect to said vertical plane.

10. A tray comprising a pair of side faces and a pair of end faces, stacking members on opposed sides of said tray, each of said stacking members having a vertical plane passing through it, said vertical plane being transverse to the direction of said opposed sides, each of said stacking members having an upper supporting surface having a longitudinal dimension that is parallel to the direction of said opposed sides and transverse to said vertical plane, each of said upper supporting surfaces having a pair of upper holding faces that are oblique in the direction of said longitudinal dimension, the faces of each pair of upper holding faces being on opposite sides of said vertical plane, each of said oblique holding faces being at an angle which allows a second tray having second stacking members with oblique faces which nest with said upper holding faces to remain in position on said upper holding faces when normally loaded and reciprocated in the direction of said longitudinal dimension but to disengage from said upper holding faces when said second tray contacts an outside object.

11. The apparatus of claim 10 wherein each of said pairs of upper holding faces extend at an upward and outward angle with respect to said vertical plane.

12. The apparatus of claim 10 wherein each of said pairs of upper holding faces extend at a downward and outward angle with respect to said vertical plane.

* * * * *